US005836043A

United States Patent [19]

Rovas

[11] Patent Number: 5,836,043

[45] Date of Patent: Nov. 17, 1998

[54] VERSATILE PAINT TRAY

[76] Inventor: Steven C. Rovas, 31 Greenleaf Meadows, Rochester, N.Y. 14612

[21] Appl. No.: 912,735

[22] Filed: Aug. 18, 1997

[51] Int. Cl.[6] ..... B44D 3/12

[52] U.S. Cl. ..... 15/257.06; 220/751; 220/757; 248/211; D32/53.1

[58] Field of Search ..... 15/257.05, 257.06; 206/762, 764, 45.24; 182/129; 220/482, 751, 757, 760; 248/210, 211, 238; D32/53.1

[56] References Cited

U.S. PATENT DOCUMENTS

| | | | |
|---|---|---|---|
| D. 248,335 | 6/1978 | Cooke et al. | D32/53.1 |
| 2,908,468 | 10/1959 | Thomas | 220/751 X |
| 3,351,970 | 11/1967 | Engh | 15/257.06 |
| 3,641,616 | 2/1972 | Bonci | 15/257.06 |
| 3,837,034 | 9/1974 | Leffert et al. | 15/257.06 |
| 4,205,411 | 6/1980 | Cupp et al. | 15/257.06 |
| 5,493,751 | 2/1996 | Misiukowiec et al. | 15/257.06 |

FOREIGN PATENT DOCUMENTS

| | | | |
|---|---|---|---|
| 805475 | 12/1958 | United Kingdom | 15/257.06 |

*Primary Examiner*—Mark Spisich
*Attorney, Agent, or Firm*—Robert J. Bird

[57] ABSTRACT

A paint tray includes a bottom, front wall, back wall, sidewalls, and a mounting bracket connected to the side walls. The mounting bracket has parallel legs, each leg including a foot at one end and a hook at the other end. The feet extend outward of the legs and are pivoted at the tops of opposite sidewalls of the tray for movement of the bracket from a storage position within the tray to an operating position behind the tray. A crossbar connects the hook ends of the legs. The hooks engage the top step of a step ladder, with the legs overlying the top step and the tray hanging from the top step in a substantially vertical attitude.

2 Claims, 2 Drawing Sheets

VERSATILE PAINT TRAY

FIELD OF THE INVENTION

This invention is a paint tray for use on a horizontal surface, or on a step ladder, or on an extension type ladder.

BACKGROUND AND INFORMATION DISCLOSURE

Painting was at one time generally done with a brush and a can of paint. If a ladder was used, the can was hung by a hook on a rung of the ladder. If a step ladder was used, the can was set on a shelf on the back side of the step ladder.

Widespread use of the paint roller as a substitute for a brush, or as a supplement to a brush, has prompted the development of the paint tray. Paint trays of various configurations are now known in the prior art. The following patents are the most relevant prior art that I know of:

U.S. Pat. No. 5,493,751 to Misiukowiec et al (Feb. 27, 1996) discloses a paint pan with a removable bracket by which to hang the pan from a rung of an extension ladder, between the ladder side rails, or to hang the pan outward of the side rails.

U.S. Pat. No. 4,205,411 to Cupp et al (1980) discloses a paint tray with a handle by which to hang the tray from a rung of an extension ladder. The handle is configured to permit the tray also to be mounted on a horizontal shelf such as that provided by a step ladder.

U.S. Pat. No. 3,351,970 to Engh (1967) discloses a paint tray with hooks by which either to hang the tray from a rung of an extension ladder, or to support the tray in an inclined horizontal position.

SUMMARY OF THE INVENTION

A paint tray according to this invention includes a bottom, front wall, back wall, sidewalls, and a mounting bracket connected to the side walls. The mounting bracket has parallel legs, each leg including a foot at one end and a hook at the other end. The feet extend outward of the legs and are pivoted at the tops of opposite sidewalls of the tray for movement of the bracket from a storage position within the tray to an operating position behind the tray. A crossbar connects the hook ends of the legs. The hooks engage the top step of a step ladder, with the legs overlying the top step and the tray hanging from the top step in a substantially vertical attitude.

DRAWING

DESCRIPTION

Figure 1:
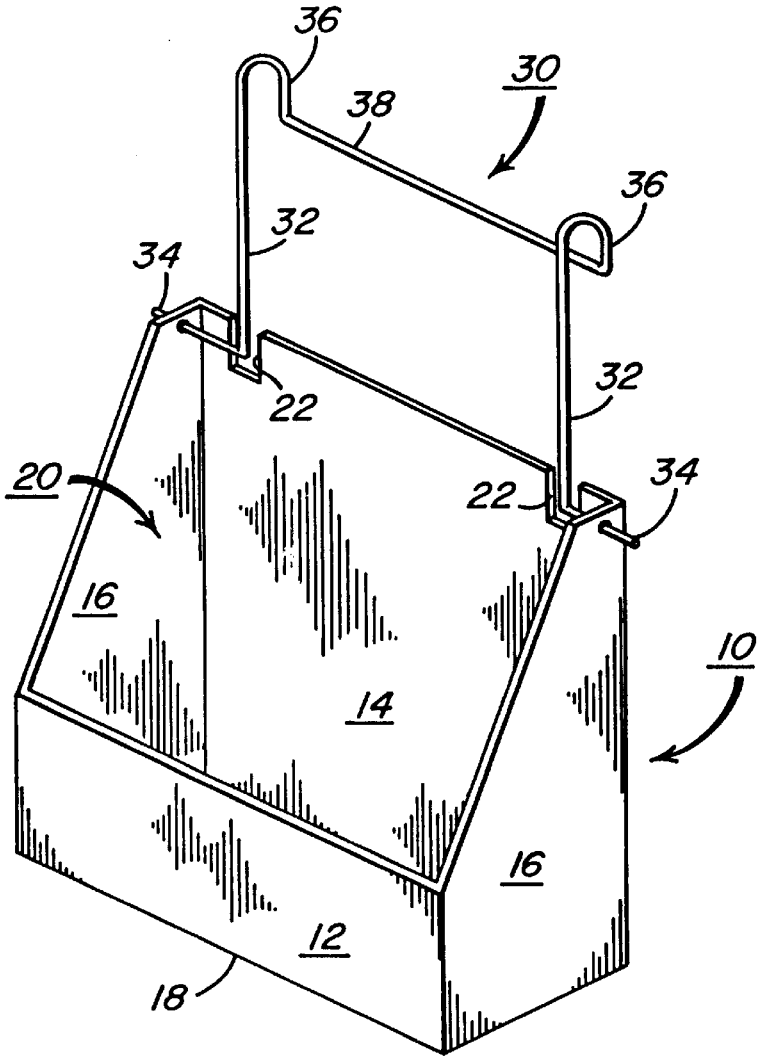
FIG. 1 is a pictorial view of my paint tray.

Referring to the drawing, my paint tray 10 includes a front wall 12, back wall 14, sidewalls 16, bottom 18, and a front opening 20 above the front wall 12, all together forming an open vessel for paint and the like.

A bracket 30 includes parallel legs 32 and a crossbar 38. Each leg includes a foot 34 at one end pivotally connected to the top the tray 10, and a hook 36 at the other end. The crossbar 38 connects the ends of hooks 36. The feet 34 extend through the tops of opposite sidewalls 16. The feet 34 extend outward so their pivotal connection with the sidewalls 16 is outward of the legs 32 and the bracket 30 is pivotable to an out-of-the-way storage position within the tray 10.

Figure 2:
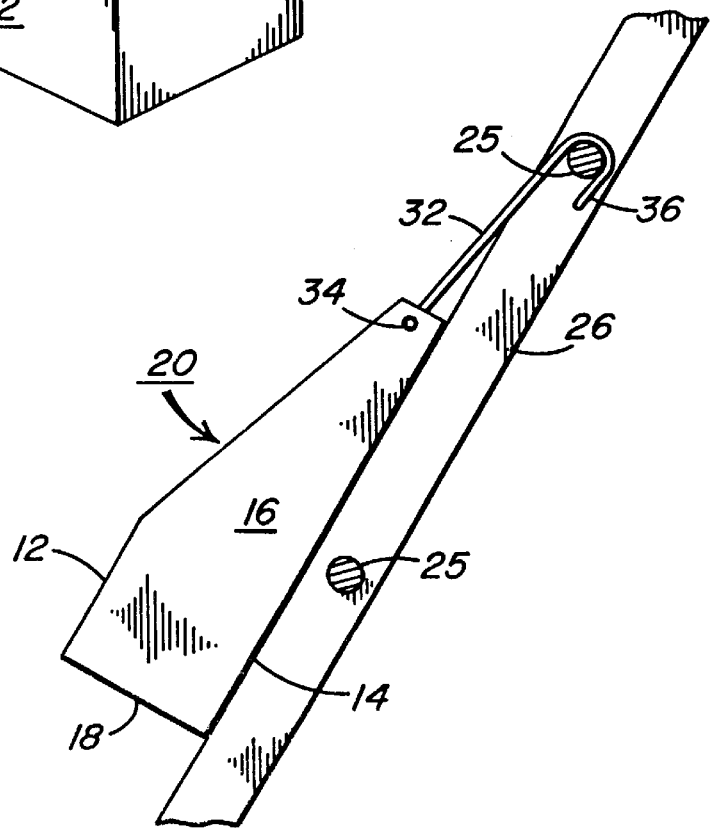
FIG. 2 shows the tray hanging from the rung of an extension ladder.

FIG. 2 shows the tray 10 hanging by its bracket 30 from a rung 25 of an extension ladder 26, to illustrate one use to which the tray is adapted.

The back wall 14 of the tray 10 includes slots 22 at the top to permit the bracket 30 to swing behind the back wall 14. The extent of pivotal travel of the bracket 30 behind the back wall 14 is determined by the depth of the slots 22.

Figure 3:
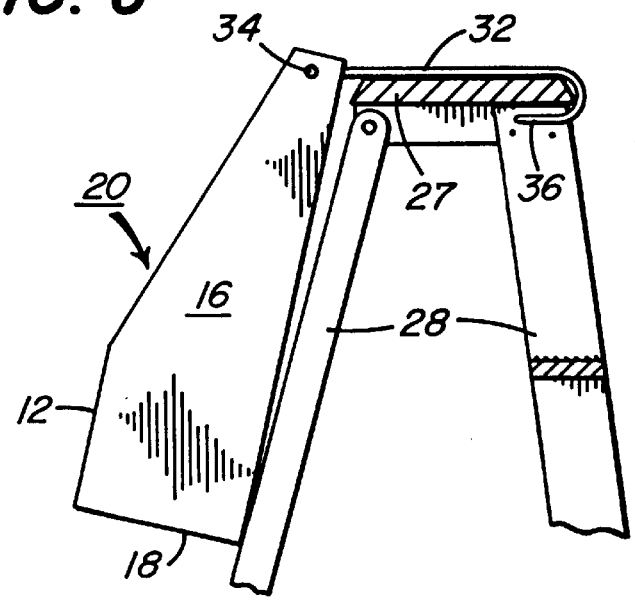
FIG. 3 shows the tray mounted on the top of a step ladder.

FIG. 3 shows the tray 10 mounted on the top step 27 of a step ladder 28. The bracket hooks 36 grip the edge of the top step 27, the bracket legs 32 overlie the top step 27, and the tray 10 hangs down the back of the ladder in a substantially vertical attitude. The hooks 36 are dimensioned to provide a snug grip on the top step 27 of the step ladder 28. This helps to prevent the bracket from sliding on the top step, to a disconnected position, and falling from the step ladder.

Figure 4:
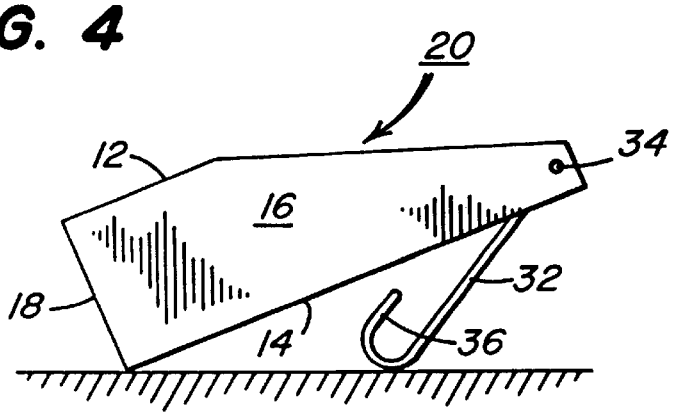
FIG. 4 shows the tray in a horizontal position.
Figure 5:
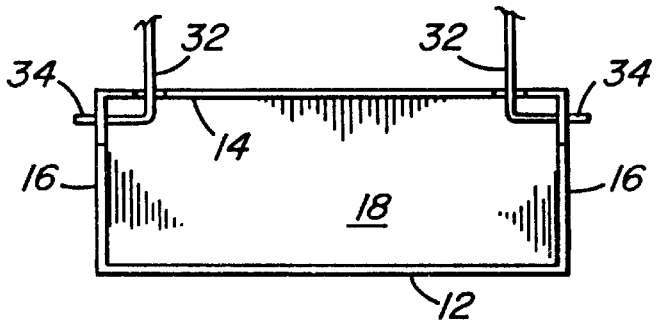
FIG. 5 is a top view of my paint tray

FIG. 4 shows the tray 10 in a relatively horizontal position, supported there by the bracket 30 at an appropriate position behind the back wall.

The foregoing description of a preferred embodiment of this invention, including any dimensions, angles, or proportions, is intended as illustrative. The concept and scope of the invention are limited only by the following claims and equivalents thereof.

What is claimed is:

1. A paint tray including a bottom, front wall, back wall, and sidewalls forming an open vessel, and further including:

a mounting bracket operatively connected to said side walls of said tray;

said mounting bracket having parallel legs, each said leg including a foot at one end and a hook at the other end;

said feet extending outward of said legs and pivotally connected to the tops of opposite sidewalls of said tray for pivotal movement of said bracket from a storage position within said tray to an operating position behind said tray; and a crossbar connecting said other ends of said legs;

said hooks being adapted to engage the top step of a step ladder with said legs overlying said top step, permitting said tray to hang from said top step in a substantially vertical attitude.

2. A paint tray as defined in claim 1 in which said pivotal movement of said bracket behind said back wall is limited by vertical slots in said back wall for movement thereinto of said legs.

* * * * *